US007088209B2

(12) United States Patent
Keck

(10) Patent No.: US 7,088,209 B2
(45) Date of Patent: Aug. 8, 2006

(54) ELECTROMAGNETIC ACTUATOR FOR OPERATING A FINAL CONTROL ELEMENT

(75) Inventor: Volker Keck, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 739 days.

(21) Appl. No.: 09/984,181

(22) Filed: Oct. 29, 2001

(65) Prior Publication Data

US 2002/0057154 A1 May 16, 2002

(30) Foreign Application Priority Data

Oct. 28, 2000 (DE) ..... 100 53 596

(51) Int. Cl.
*H01F 3/00* (2006.01)

(52) U.S. Cl. ..... 335/279; 251/129.15; 123/90.11; 335/251; 335/256

(58) Field of Classification Search ..... 123/90.11; 335/251–256, 279, 281; 251/129.15
See application file for complete search history.

(56) References Cited

U.S. PATENT DOCUMENTS 3,647,177 A * 3/1972 Lang ..... 251/129.15
3,934,815 A * 1/1976 Marsden ..... 251/129.19
4,290,039 A * 9/1981 Tochizawa ..... 335/262
4,515,343 A * 5/1985 Pischinger et al. ..... 251/48
4,668,023 A * 5/1987 Every et al. ..... 303/119.2
5,402,093 A * 3/1995 Gibas et al. ..... 335/261
6,027,037 A * 2/2000 Murakami et al. ..... 239/88
6,308,667 B1 * 10/2001 Tsai et al. ..... 123/90.11
6,550,745 B1 * 4/2003 Bergstrom et al. ..... 251/129.16
2003/0052763 A1 * 3/2003 Padroni ..... 335/220

FOREIGN PATENT DOCUMENTS

| | | |
|---|---|---|
| JP | 58-122706 | 7/1983 |
| JP | 63-285379 | 11/1988 |
| JP | 1-145431 | 6/1989 |
| JP | 2000-73720 | 3/2000 |
| WO | WO 00/46490 | 8/2000 |

* cited by examiner

*Primary Examiner*—Lincoln Donovan
*Assistant Examiner*—Bernard Rojas
(74) *Attorney, Agent, or Firm*—Crowell & Moring LLP

(57) ABSTRACT

An electromagnetic actuator for operating a final control element has at least one solenoid which is arranged in a housing and acts upon an armature constructed of laminations oriented essentially toward control element. The control element may be a charge cycle valve. At least one lamination of the armature has at least one passage opening which forms a duct for transporting a medium.

16 Claims, 3 Drawing Sheets

ELECTROMAGNETIC ACTUATOR FOR OPERATING A FINAL CONTROL ELEMENT

This application claims the priority of German application 100 53 596.8, filed Oct. 28, 2001, the disclosure of which is expressly incorporated by reference herein.

BACKGROUND AND SUMMARY OF THE INVENTION

The present invention relates to an electromagnetic actuator for operating a final control element including at least one solenoid which is arranged in a housing, and an armature constructed of laminations upon which the solenoid acts.

An electromagnetic actuator for operating a final control element of the type mentioned above is known from International Patent Document WO 00/46490. The final control element is a charge cycle valve of an internal-combustion engine. The actuator has at least one solenoid formed by a yoke body having a coil, which yoke body has a pole face. The actuator also has an armature element which can be moved back and forth with respect to the pole face by way of a guide pin. The armature element consists of an armature plate which is fixedly connected with the guide pin. The armature plate has two cover plates between which a bundle of laminations is arranged. The bundle consists of a plurality of laminations which are fixedly connected with one another, are aligned perpendicular to the cover plates, and are connected with the latter.

An electromagnetic actuator for operating a charge cycle valve of an internal-combustion engine is known from earlier German Patent Application DE 100 35759.8. The actuator has a swivelling armature which is swivellable about an axis disposed between two solenoids. The armature has a duct for transporting a medium, the duct extending, transversely to the moving direction of the armature, through the armature.

It is an object of the invention to further develop an actuator of the above-mentioned type.

According to the invention, this object is achieved by providing at least one of the laminations of which the armature is constructed with at least one passage opening which forms a duct for transporting a medium.

A process of assembling the electromagnetic actuator, moreover, includes constructing the armature upon which at least one solenoid is to act of individual laminations, and automatically creating the duct for transporting the medium when the individual laminations are joined to construct the armature.

One significant advantage of the invention relates to the simple production of the duct. The duct is automatically created when individual laminations are joined to form the armature; before assembly, only the passage opening has to be made in the lamination, for example, by laser cutting or punching. After the individual laminations are joined to form a bundle of laminations forming the armature, the passage opening is laterally bounded by adjacent laminations. If, advantageously, several laminations are provided with several passage openings, then, as a result of grouping and nesting the laminations having the passage openings, arbitrary duct cross-sections and courses can be implemented. Curved contours can also be implemented within a lamination, which would not be possible if the duct were drilled. The duct can advantageously be used at low constructive expenditures for supplying a play compensation element, for lubricating bearings of the armature, and/or for cooling the armature.

Further developments, embodiments, and advantages of the invention are claimed and described.

DETAILED DESCRIPTION OF THE INVENTION

Figure 1:
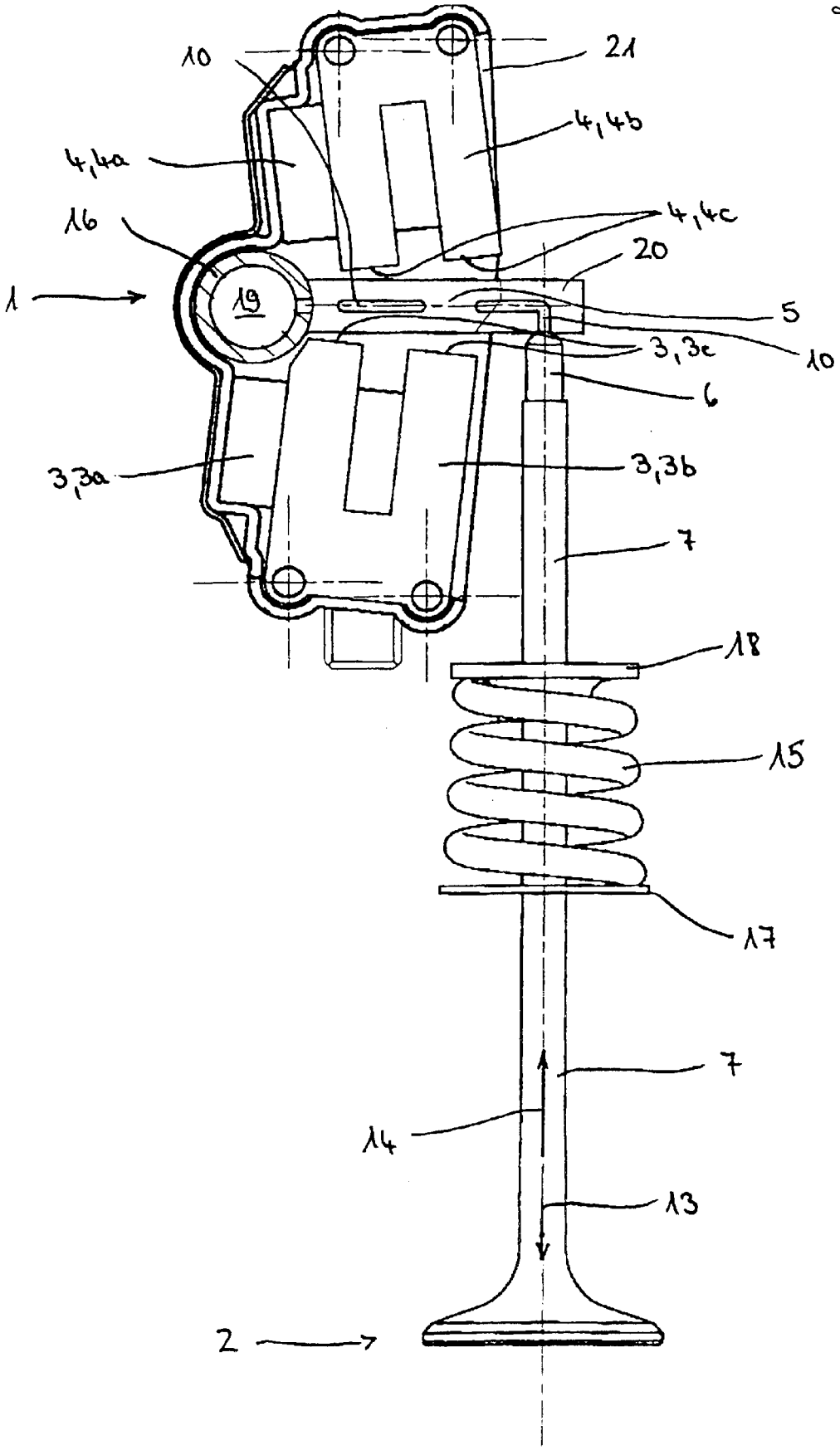
FIG. 1 is a cross-sectional view of a schematically illustrated actuator according to the invention having an armature constructed of laminations which has a duct according to the invention.

FIG. 1 illustrates an electromagnetic actuator 1 for operating a final control element; in the present case, the final control element is a charge cycle valve 2 of an internal-combustion engine which is not shown in detail. The actuator 1 has an electromagnetic unit with two solenoids or magnets 3 and 4—an opening solenoid or magnet 3 and a closing solenoid or magnet 4. Each of the solenoids 3, 4 has a magnet coil 3*a*, 4*a* wound onto a coil carrier, which is not shown in detail, and a yoke 3*b*, 4*b* with two yoke legs which, by means of their faces, form pole faces 3*c*, 4*c*. Between the pole faces 3*c*, 4*c*, a swivelling armature 5 is disposed to be swivellable back and forth about an axis. The swivelling armature 5 acts by way of a play compensation element 6 and by way of a valve stem 7 upon the charge cycle valve 2. By way of a stem guide, which is not shown, the valve stem 7 is axially displaceably disposed in a cylinder head of the internal-combustion engine.

Figure 2:
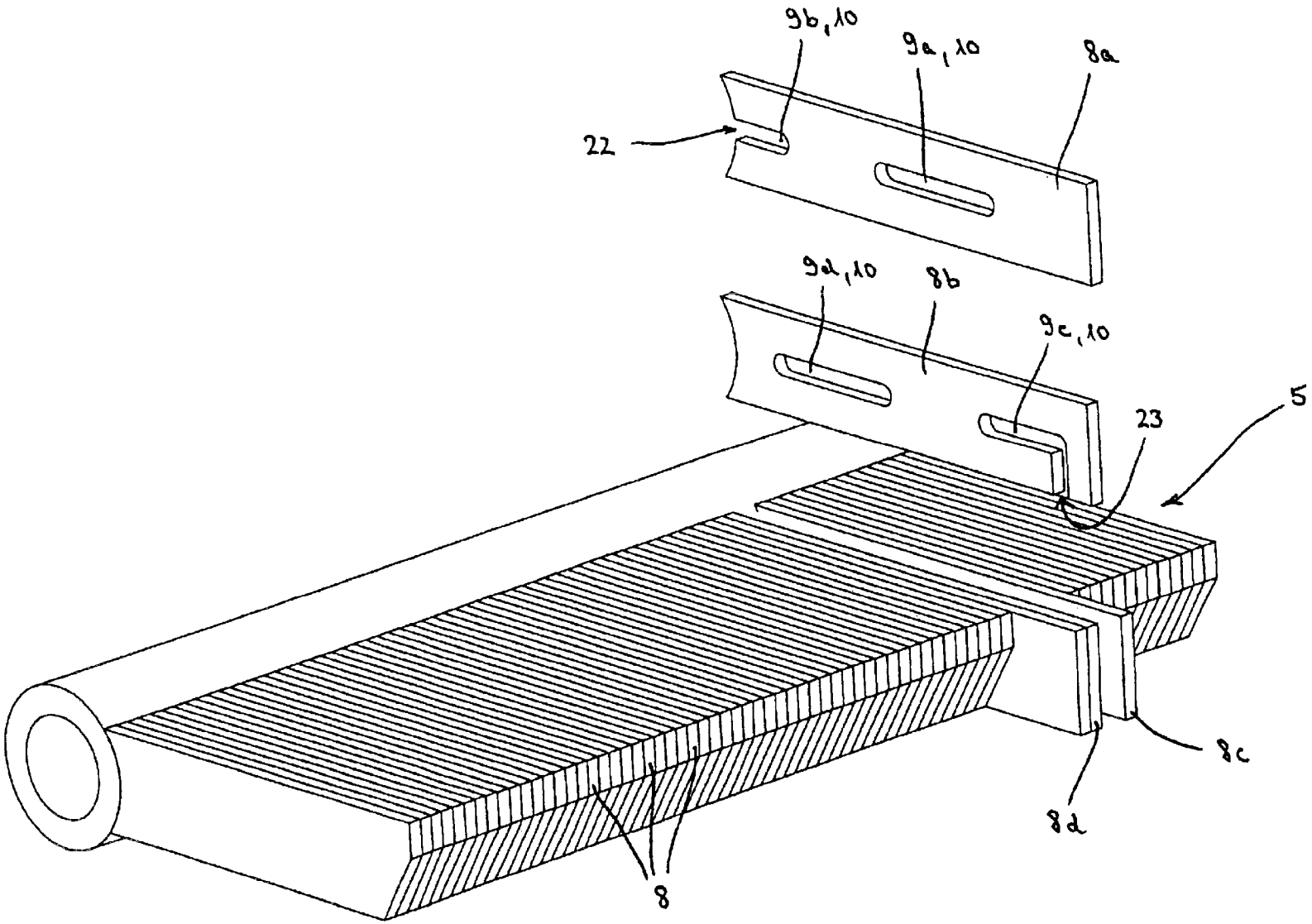
FIG. 2 is a lateral perspective view of the laminated armature with two individual laminations taken out of the bundle of laminations.
Figure 3:
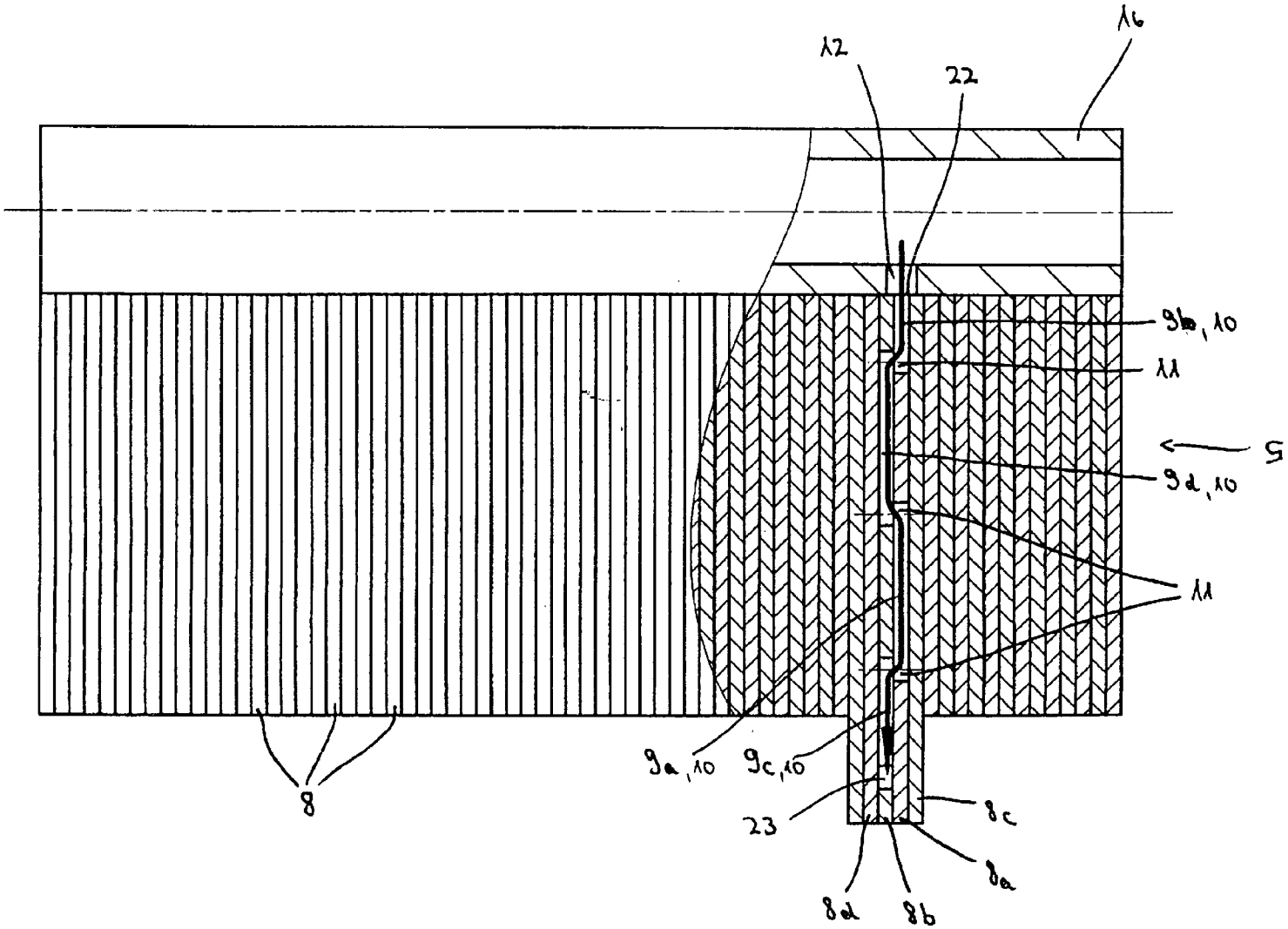
FIG. 3 is a partial longitudinal sectional view of the armature.

According to FIG. 2, the swivelling armature 5 is constructed of laminations aligned essentially in the direction of the charge cycle valve 2. These laminations are connected with one another, for example, by crimping or welding. According to the invention, at least one lamination 8 of the swivelling armature 5 has at least one passage opening with a freely selectable cross-section, such as an oval slot, which forms a duct 10 for transporting a medium. Each of the laminations 8*a* and 8*b* shown in FIG. 2 has two passage openings 9*a*, 9*b*, 9*c*, and 9*d*; these passage openings are laterally bounded by the adjacent laminations 8*c* and 8*d*. The passage opening 9*b* of the lamination 8*a* has an inlet 22 for the medium and the passage opening 9*c* of the lamination 8*b* has an outlet 23 for the medium. The passage openings 9*a* to 9*d* are made, for example, by laser cutting or punching in the laminations 8*a*, 8*b* of the swivelling armature 5 and are each provided with overlapping areas 11, illustrated in FIG. 3, by which they are connected with one another for forming the duct. The passage opening 9*b* of the lamination 8*a* is additionally connected by way of the inlet 22 with an oil intake duct 12 (FIG. 3), and the passage opening 9*c* of the lamination 8*b* is connected with the play compensation element 6 (FIG. 1) by way of the outlet 23.

Furthermore, the actuator 1 according to FIG. 1 has a spring mechanism with two prestressed valve springs, specifically with a valve spring, which is not shown here, which is constructed as a torsion spring and which acts in the opening direction 13, and with a valve spring 15 which is constructed as a coil pressure spring and acts in the closing direction 14. The swivelling armature 5 is fixedly welded to a hollow swivel pin 16 which, in a manner not illustrated here, is disposed in two bearings in the actuator housing 21. The torsion spring, which is not shown here, is non-rotatably connected by one end with the actuator housing 21 and, by way of the swivel pin 16, the swivelling armature 5 and the valve stem 7, acts upon the charge cycle valve 2. The coil pressure spring 15 is supported by way of a first spring support 17 on the cylinder head and acts by way of a second spring support 18 and by way of the valve stem 7 upon the charge cycle valve 2. When the solenoids 3, 4 are not energized, the swivelling armature 5 is held by the valve springs 15 in a state of equilibrium between the pole faces 3*c*, 4*c* of the solenoids 3, 4.

When the actuator 1 is activated during a start, the closing magnet 4 or the opening magnet 3 are overexcited for a short time, or the swivelling armature 5 with a starting routine is excited by means of its resonant frequency in order to be drawn out of the state of equilibrium. In the closed position of the charge cycle valve 2, the swivelling armature 5 is disposed on the pole face 3*c*, 4*c* of the excited closing magnet 4 and is held by the latter. The closing magnet 4 further prestresses the valve spring acting in the opening direction 13. In order to open the charge cycle valve 2, the closing magnet 4 is disconnected 4 and the opening magnet 3 is connected. The valve spring acting in the opening direction 13 accelerates the swivelling armature 5 beyond the state of equilibrium so that the latter is attracted by the opening magnet 3.

The swivelling armature 5 places itself against the pole face 3*c* of the opening magnet 3 and is held by the latter. In order to close the charge cycle valve 2 again, the opening magnet 3 is disconnected and the closing magnet 4 is connected. The valve spring 15 acting in the closing direction 14 accelerates the swivelling armature 5 beyond the state of equilibrium toward the closing magnet 4. The swivelling armature 5 is attracted by the closing magnet 4, places itself against the pole face 4*c* of the closing magnet 4, and is held by the latter.

From a pressure connection, not shown in detail, internal-combustion engine oil arrives in the cavity 19 of the swivel pin 16. From this cavity 19, the internal-combustion engine oil, by way of the oil intake duct 12, arrives in the duct 10 which, according to the invention, leads into a projection 20 molded to the swivelling armature 5 and forming a valve gear. The internal-combustion machine oil is guided from the projection 20 into the play compensation element 6 for the pressure medium supply.

Furthermore, the duct 10 may be constructed such that, in addition or exclusively, it supplies the bearings of the swivelling armature 5 with oil and/or is used for cooling the swivelling armature 5. Accordingly, the medium guided in the duct 10 may be formed by various substances which are designed, for example, mainly for heat removal or for lubrication. Particularly advantageously, the medium is formed by an internal-combustion engine oil which can be utilized as a pressure medium for a play compensation element, for cooling, and for lubrication, and which is basically available in an internal-combustion engine. In order to achieve an advantageous cooling of the armature, the duct 10 may extend, transversely to the moving direction of the armature, through the armature. In order to achieve a large cooling surface and an advantageous heat dissipation while the pressure loss is low, the duct may extend through the armature in a curving or meandering manner.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

I claim:

1. An electromagnetic actuator for operating a control element comprising:

at least one solenoid which is arranged in a housing, and an armature constructed of laminations upon which the at least one solenoid acts, wherein at least one of said laminations of which the armature is constructed has at least one passage opening which forms a duct for transporting oil and supplying the oil into a play compensation element for the pressure medium supply which can compensate for armature play.

2. An electromagnetic actuator for operating a control element comprising:

at least one solenoid which is arranged in a housing, and an armature constructed of laminations upon which the at least one solenoid acts, wherein at least one of said laminations of which the armature is constructed has at least one passage opening which forms a duct for transporting a medium, and wherein the at least one passage opening of the at least one of said laminations is laterally bounded by adjacent laminations and has at least one inlet as well as at least one outlet for the medium.

3. The electromagnetic actuator according to claim 1, wherein said at least one of said laminations is one of several laminations having passage openings which are provided with overlapping areas by way of which each passage opening is connected with at least one passage opening made in an adjacent lamination.

4. An electromagnetic actuator for operating a control element comprising:

at least one solenoid which is arranged in a housing, and an armature constructed of laminations upon which the at least one solenoid acts, wherein at least one of said laminations of which the armature is constructed has at least one passage opening which forms a duct for transporting a medium, and wherein the armature is a swivelling armature which is disposed in at least two bearings.

5. The electromagnetic actuator according to claim 4, wherein the bearings of the swivelling armature are supplied with lubricant by way of the duct.

6. An electromagnetic actuator for operating a control element comprising:

at least one solenoid which is arranged in a housing, and an armature constructed of laminations upon which the at least one solenoid acts, wherein at least one of said laminations of which the armature is constructed has at least one passage opening which forms a duct for transporting a medium, and wherein the duct is used for cooling the armature.

7. The electromagnetic actuator according to claim 1, wherein the at least one passage opening has a curved contour.

8. The electromagnetic actuator according to claim 1, wherein the control element is a charge cycle valve of an internal-combustion engine.

9. The electromagnetic actuator according to claim 2, wherein said at least one of said laminations is one of several laminations having passage openings which are provided with overlapping areas by way of which each passage opening is connected with at least one passage opening made in an adjacent lamination.

10. The electromagnetic actuator according to claim 2, wherein the duct is adapted to supply pressure medium to a play compensation element which can compensate for armature play.

11. The electromagnetic actuator according to claim 4, wherein the duct is used for cooling the armature.

12. The electromagnetic actuator according to claim 5, wherein the duct is used for cooling the armature.

13. The electromagnetic actuator according to claim 2, wherein the at least one passage opening has a curved contour.

14. The electromagnetic actuator according to claim 3, wherein the at least one passage opening has a curved contour.

15. The electromagnetic actuator according to claim 9, wherein the at least one passage opening has a curved contour.

16. The electromagnetic actuator according to claim 8, wherein the armature is oriented essentially toward the charge cycle valve.

* * * * *